US006523329B2

(12) United States Patent
Hirano et al.

(10) Patent No.: US 6,523,329 B2
(45) Date of Patent: Feb. 25, 2003

(54) METHOD FOR PACKING AND SEALING A ZEOLITE ADSORBENT WITH A DEHYDRATING AGENT

(75) Inventors: Shigeru Hirano, Yamaguchi-ken (JP); Katsuyuki Morikuni, Yamaguchi-ken (JP)

(73) Assignee: Tosoh Corporation, Shinnanyo (JP)

( * ) Notice: Subject to any disclaimer, the term of this patent is extended or adjusted under 35 U.S.C. 154(b) by 0 days.

(21) Appl. No.: 10/102,857

(22) Filed: Mar. 22, 2002

(65) Prior Publication Data

US 2002/0144487 A1 Oct. 10, 2002

Related U.S. Application Data

(62) Division of application No. 09/531,456, filed on Mar. 20, 2000, now Pat. No. 6,401,432.

(30) Foreign Application Priority Data

Mar. 23, 1999 (JP) ..... 11-077259

(51) Int. Cl.[7] ..... B65B 29/00
(52) U.S. Cl. ..... 53/400; 53/492
(58) Field of Search ..... 53/400, 469, 474, 53/475, 479, 492

(56) References Cited

U.S. PATENT DOCUMENTS 2,524,162 A * 10/1950 Chavannes et al.
2,529,837 A * 11/1950 Denison ..... 53/479
4,972,658 A * 11/1990 Greenbank ..... 53/475
5,111,640 A * 5/1992 Tokunaga et al. ..... 53/474
5,267,646 A * 12/1993 Inoue et al.
5,657,866 A * 8/1997 Kaneko et al.
5,693,399 A * 12/1997 Himeshima et al.
5,789,044 A * 8/1998 Ram et al. ..... 53/400
6,000,198 A * 12/1999 Tramposch ..... 53/400
6,131,368 A * 10/2000 Tramposch et al. ..... 53/400

FOREIGN PATENT DOCUMENTS

EP 0719715 A1 * 7/1996
GB 2306169 A * 4/1997
JP 10-181792 A * 7/1998
JP 11-59782 A * 3/1999
WO WO-97-45335 * 12/1997

* cited by examiner

*Primary Examiner*—Stephen F. Gerrity
(74) *Attorney, Agent, or Firm*—Oblon, Spivak, McClelland, Maier & Neustadt, P.C.

(57) ABSTRACT

A method for packaging a zeolite adsorbent, which comprises introducing the zeolite adsorbent into a packaging bag having an opening and comprising at least two layers including a metal layer, through said opening, sealing the bag above the introduced zeolite adsorbent, then introducing a dehydrating agent thereon, and sealing the bag above the introduced dehydrating agent.

1 Claim, 1 Drawing Sheet

METHOD FOR PACKING AND SEALING A ZEOLITE ADSORBENT WITH A DEHYDRATING AGENT

Application is a Division of Ser. No. 09/531,456 filed Mar. 20, 2000 now U.S. Pat. No 6,401,432.

BACKGROUND OF THE INVENTION

1. Field of the Invention

The present invention relates to a method for packaging a zeolite adsorbent. More particularly, it relates to a method for properly packaging, storing and transporting a zeolite adsorbent while suppressing its deterioration. The zeolite adsorbent is useful for separating and recovering oxygen gas, nitrogen gas, carbon dioxide, hydrogen gas or carbon monoxide by separating a gas mixture by a method represented e.g. by a pressure swing adsorption method. Further, the present invention relates to a method for properly filling an adsorption tower with a zeolite adsorbent by means of the packaged zeolite adsorbent.

2. Discussion of the Related Art

A zeolite adsorbent is used usually in a state having moisture removed (activated state). Water shows the highest affinity to such a zeolite adsorbent, and when the zeolite adsorbent in an activated state is in contact with air, it readily adsorbs moisture in the air, and consequently, adsorption sites will be occupied by water molecules, and adsorption of gas molecules will thereby be hindered, thus leading to deterioration of adsorption performance of the zeolite adsorbent.

Therefore, when a zeolite adsorbent in an activated state is to be stored or shipped as a product, it is packaged and then is stored or shipped as a packaged product, so that the zeolite adsorbent will not adsorb moisture present in air.

A zeolite adsorbent product is usually shipped as packaged in a package such as a drum or a supersack (flexible container). If the package is a drum, the product can be packaged in an optional amount within a range of from a few liters to 200 liters depending upon the request by a customer, and it is possible to shield it completely from air by clamping a cover with e.g. a bolt by means of a jig, whereby once it is packaged, substantially no moisture absorption will take place unless the cover of the drum will be opened.

Thus, the packaging method by means of a drum is a method whereby absorption of moisture in air is minimum, and it is utilized as a packaging method for a zeolite adsorbent which is especially desired not to absorb moisture. However, except for a specially designed one, the packaging capacity of a drum is usually at a level of 200 l (about 120 kg when the bulk density of the zeolite adsorbent is 0.6 kg/l) at the maximum, and thus, the drum is not suitable for shipping in a large scale at a level of a few tens tons. For example, for shipment of 50 tons of a zeolite adsorbent, a large number of drums, i.e. at least 400 drums of 200 l capacity, will be required. As the number of drums is large, it takes time for the operation of filling an adsorption tower with the zeolite adsorbent from the drums, whereby substantial moisture will be absorbed until filling of the adsorption tower with the adsorbent has been completed.

When such a large amount of the adsorbent is to be shipped, stored or transported, it is common to employ a supersack (flexible container) having a packaging capacity larger than a drum. The packaging capacity of a supersack is usually from 100 kg to 1 ton, and the supersack is capable of packaging a larger amount of the zeolite adsorbent than a drum. The supersack is composed of an outer bag and an inner bag, and the zeolite adsorbent is put and packaged in the inner bag. As the inner bag, a polyethylene bag is commonly employed for such a reason that the price is low and the handling is relatively simple. However, polyethylene has moisture permeability, and it has been difficult to completely suppress moisture permeability through the material of the inner bag, although an attempt has been made to suppress moisture permeability through the material of the inner bag by a method of making the inner bag to have a double layer structure for packaging the adsorbent.

Further, when the package is a supersack, the inlet portion of the inner bag for the adsorbent is usually tied first by a string for sealing, but is not completely sealed. Accordingly, the open air will penetrate into the inner bag through a clearance slightly present at the sealed portion, whereupon the zeolite adsorbent will absorb the moisture. To prevent the moisture absorption from the sealed portion, sealing may be carried out at two or more positions. Even in such a state, complete airtight sealing is difficult, and moisture will still penetrate into the inner bag. Further, the zeolite adsorbent has a nature to repeat adsorption and desorption of air along with an increase or decrease of the temperature. Accordingly, if a clearance exists at a sealed portion, the open air will be sucked in due to the temperature difference between day time and night time, whereupon the zeolite adsorbent will absorb moisture. On the other hand, inversely, due to an increase of the temperature, the zeolite adsorbent may desorb the adsorbed gas. In such a case, if the packaging bag is completely sealed, the desorption gas will not be discharged out of the packaging bag, and the inner pressure of the bag will increase, and the bag may break, so that the packaged zeolite adsorbent will be in contact with the open air and will be deteriorated by absorption of moisture.

Further, when the zeolite adsorbent is packaged, the product transporting line will be shielded from the open air and maintained to be in a state where the dew point is low, until the product has been packaged, so that moisture absorption will not take place during the transportation through this transporting line until the zeolite adsorbent has been packaged. However, even if a due care is taken to avoid moisture absorption in the product transporting line until the product has been packaged, it is extremely difficult to avoid moisture absorption from the sealed portion of the inner bag or through the material of the inner bag of the supersack during the storage of the product in a warehouse or during the transportation by a ship over a long period of time.

JP-A-10-181792 proposes to provide at least one vent on the side of a supersack for packaging a powder, and a water- and moisture-proofing cloth is stitched on the front side of this vent, and the stitching is done along both side portions and the upper portion only, and the lower portion is left unstitched so that the inner air of the supersack may flow out through the unstitched portion. However, even if such a packaging bag is used for packaging a zeolite adsorbent, the zeolite adsorbent has a nature to repeat adsorption and desorption of a gas due to a change of the open air temperature and has a high adsorption affinity to the gas, and accordingly, even through a slight clearance, the open air is likely to flow into the bag and moisture adsorption will take place. Although, JP-A-10-181792 proposes to provide a water- and moisture-proofing cloth, if a clearance is present at any portion of the bag, the open air will flow in therethrough, and the packaged zeolite adsorbent will be moistened. Even if the four sides of the water- and moisture-proofing cloth were stitched, the amount of the open air passing through due to the adsorption and desorption of the zeolite adsorbent would be large, and the water- and moisture-proofing cloth would soon be saturated by moisture, whereby storage or transportation for a long period of time would be difficult. Further, with respect to sealing of the inlet for the powder, no moisture-proofing means is provided, and it is unavoidable that the zeolite adsorbent will absorb moisture penetrating from the clearance of this sealing portion.

Further, in JP-A-11-59782, a packaging material for transportation excellent in air tightness is employed, and sealing is done by heat sealing. The heat sealing is a sealing method to provide high air tightness, but the heat sealing operation is difficult when a large size supersack is to be sealed. Further, in packaging of a zeolite adsorbent having a nature to repeat adsorption and desorption of a gas, if the packaging bag is completely sealed, when a large amount of gas is desorbed from the zeolite adsorbent, the inner pressure of the packaging bag will increase, and the packaging bag may break. Accordingly, ventilation of the gas will be required.

SUMMARY OF THE INVENTION

As described above, for packaging, storing or transporting a zeolite adsorbent by a conventional packaging bag or packaging method, it has been desired to develop a method whereby the operation efficiency can be improved while avoiding deterioration of the quality of the zeolite adsorbent packaged.

The zeolite adsorbent has extremely high affinity to water as compared with the affinity to other gas molecules, and if it absorbs moisture in air before it is used as an adsorbent, its adsorbing performance will substantially decrease, and it will not be able to provide an adequate adsorbing performance. Accordingly, if the zeolite adsorbent is moistened during transportation or storage until shipment after the production thereof, the performance as an adsorbent will deteriorate. Accordingly, it has been desired to avoid moisture adsorption as far as possible. Further, it is necessary to avoid breakage of the packaging bag even if a gas is desorbed from the zeolite adsorbent due to a change of the open air temperature during the storage or transportation. Especially when the production, packaging, storage or transportation is carried out in a large scale as an industrial scale, it is necessary to provide a corresponding precautional measure for packaging, storage and transportation. Further, it is necessary to fill an adsorption tower with a zeolite adsorbent simply and in a short period of time, when the packaged zeolite adsorbent is to be practically used.

Under these circumstances, it is an object of the present invention to provide a packaging method whereby the zeolite adsorbent can be packaged without substantial deterioration as a product, and it will not be moistened during the storage or transportation.

Further, it is another object of the present invention to provide a filling method whereby the zeolite adsorbent thus packaged can be packed into an adsorption tower without deterioration.

The present inventors have conducted extensive studies on the material of a packaging bag which can be used as an inner bag of a supersack, and a packaging method, and further on a method for filling an adsorption tower with a zeolite adsorbent by means of the packaged zeolite adsorbent. As a result, we have found that moisture absorption of a zeolite adsorbent as a product can be prevented by a method for packaging a zeolite adsorbent, which comprises introducing the zeolite adsorbent into a packaging bag having an opening and comprising at least two layers including a metal layer, through said opening, sealing the bag above the introduced zeolite adsorbent, then introducing a dehydrating agent thereon, and sealing the bag above the introduced dehydrating agent, particularly that it is possible to certainly prevent penetration of moisture from the open air by the method wherein at the time of sealing the bag above the introduced dehydrating agent, the packaging bag is folded back and sealed at two or more positions, and further that it is possible to prevent moisture absorption during the period until the zeolite adsorbent is packaged, by the method wherein the packaging is carried out in an atmosphere of dehumidified air having a dew point of not higher than −30° C. Further, the present inventors have found it possible to fill an adsorption tower simply and in a short period of time by a method which comprises moving a zeolite adsorbent packaged by the above packaging method to a position above the adsorption tower to be packed, and then opening a lower portion of the packaging bag to let the zeolite adsorbent drop into the adsorption tower to be packed. The present invention has been accomplished on the basis of these discoveries.

BRIEF DESCRIPTION OF THE DRAWINGS

In the accompanying drawings.

DETAILED DESCRIPTION OF THE EMBODIMENTS

Figure 1:
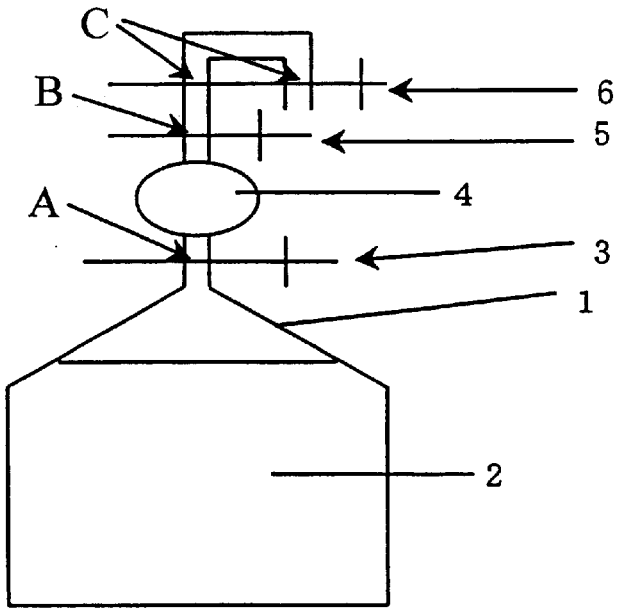
FIG. 1 is a schematic view illustrating the sealing method carried out in Examples 1 to 3 and Comparative Example 2.

In the Figures, reference numeral 1 indicates a packaging inner bag, numeral 2 a zeolite adsorbent (product), numeral 3 a plastic binding band used for sealing at position A, numeral 4 a dehydrating agent, numeral 5 a plastic binding band used for sealing at position B, and numeral 6 a plastic binding band used for sealing at position C.

Now, the present invention will be described in detail with reference to the preferred embodiments.

The method for packaging a zeolite adsorbent according to the present invention, is a method which comprises introducing the zeolite adsorbent into a packaging bag having an opening and comprising at least two layers including a metal layer, through said opening, sealing the bag above the introduced zeolite adsorbent, then introducing a dehydrating agent thereon, and sealing the bag above the introduced dehydrating agent.

The packaging bag to be used in the present invention may, for example, be one to be used for the inner bag of a supersack, which is capable of packaging at least about 200 l of a zeolite adsorbent as a product, which can hardly be packaged by one drum. When a zeolite adsorbent of a smaller volume is to be packaged, it is common to employ a drum having high air tightness, although a supersack may also be employed. A supersack comprises an outer bag and an inner bag. The outer bag is preferably made of a material and of a structure to be lifted by e.g. a crane. The inner bag is disposed inside of the outer bag, and the zeolite adsorbent as a product is packaged in the inner bag. At the time of packaging, the zeolite adsorbent as a product is introduced into the interior of the inner bag of the supersack from an opening at the upper portion of the inner bag of the supersack, and packaged by sealing the bag above the zeolite adsorbent, and then stored or transported.

Further, when the zeolite adsorbent is to be filled into another vessel such as an adsorption tower to carry out adsorption and separation, the supersack is lifted by e.g. a crane, and the outer bag and the inner bag of the supersack are opened to let the zeolite adsorbent drop from the lower portion into the vessel such as the adsorption tower. The outlet from which the zeolite adsorbent is discharged, is usually smaller than the inlet from which the zeolite adsorbent is introduced into the interior of the inner bag, and to prevent moisture from entering therefrom, heat sealing is carried out to provide high air tightness. By moving the zeolite adsorbent packaged in the packaging bag by the packaging method of the present invention, to a position above an adsorption tower and opening the lower portion of the packaging bag, only the zeolite adsorbent can be dropped into the adsorption tower without letting the dehydrating agent drop, to fill the adsorption tower with the zeolite adsorbent. Especially, even when a bag for packaging a large amount like a supersack, is used, filling of the adsorption tower can be carried out simply all at once in a short period of time, whereby it is possible to avoid deterioration by moisture absorption such that the zeolite adsorbent will be in contact with the open air and absorbs moisture.

The packaging bag to be used in the present invention is made of a composite film having a layered structure having at least two layers including a metal layer such as an aluminum, gold, silver or cupper layer. Among these metal layers, an aluminum layer is preferably employed from the viewpoint of e.g. the price. With respect to the structure of the packaging bag, the number and types of layers constituting the bag are not particularly limited so long as such layers include a metal layer and provide a performance such that the zeolite adsorbent as a product can be stored or transported without moisture absorption.

With respect to the thickness of the metal layer, as the thickness increases, moisture permeation through the packaging bag tends to more hardly take place, and if the thickness decreases, the strength decreases, and the metal layer tends to be susceptible to damages. Accordingly, the metal layer is usually at least 1 $\mu$m, so that moisture permeation through the material of the inner bag of a supersack can be prevented, and the strength will be sufficient for normal use.

The layered structure of the inner bag of the packaging bag may have at least two layers including a metal layer. Usually, it has a structure having the metal layer sandwiched to prevent the metal layer from receiving a damage. The structure is preferably one having from 3 to 7 layers in total. As materials other than the metal layer, resins such as polyethylene terephthalate (PET), nylon and linear low-density polyethylene, may, for example, be used.

After the zeolite adsorbent is introduced into the packaging bag, the upper portion of the bag will be sealed. As a method for sealing the packaging bag, a heat sealing method or a method of tying by means of a string or the like, may, for example, be employed. Usually, the sealing is carried out by a method of tying by means of a string or the like. As the string or the like to be used for sealing, it is common to employ a plastic binding band or a string made of e.g. polyethylene, polypropylene or a vinyl resin. Otherwise, a fine wire may also be employed, but in such a case, a due care is required for sealing so as not to damage the packaging bag. Further, at the time of sealing with a string or the like, a special jig or machine may be employed to carry out the sealing more firmly.

Thus, the packaging bag is sealed after the zeolite adsorbent is introduced into the bag. However, it is difficult to completely seal the packaging bag even if it is firmly sealed not to damage the packaging bag, and it is unavoidable that a slight clearance will form which communicates with the open air. Accordingly, a dehydrating agent is sealed in at the sealing portion in order to remove moisture entering from the open air, whereby moisture absorption of the zeolite adsorbent can be prevented. When the zeolite adsorbent is packaged by the method of the present invention, the sealing portions will be at least two positions i.e. one above the zeolite adsorbent as a product (i.e. between the dehydrating agent and the zeolite adsorbent as the product) and the other above the dehydrating agent. Further, even if moisture enters from a clearance at the sealing portion, in order to delay its diffusion, the number of sealing positions may be increased, or the packaging bag may be folded bag above the dehydrating agent and further sealed. Namely, the packaging bag may be sealed at at least three positions in total. Especially by folding and sealing the packaging bag, there will be, in addition to the above described effect, additional advantages such that entrance of foreign matters can be prevented, and the packaging bag (inner bag) containing the zeolite adsorbent can be made more compact so that it can easily inserted into the outer bag.

Further, the zeolite adsorbent has a nature to adsorb a large amount of a gas and to desorb the adsorbed gas when the temperature rises. Accordingly, in a case where it is packaged when the temperature is low and shipped to a region or in a season where the temperature is high, if the packaging bag is air-tightly sealed by a method such as heat sealing, a high pressure will be exerted in the interior of the packaging bag, and in some cases, the packaging bag may be broken by the inner pressure. According to the packaging method of the present invention, although the packaging bag is sealed firmly by a string or the like, it is not completely sealed, and therefore the gas desorbed from the zeolite adsorbent, can escape out of the packaging bag through a clearance slightly formed at the sealing portion, whereby the packaging bag will not be broken.

The type of the dehydrating agent to be used in the method of the present invention, is not particularly limited, and usually, silica gel, activated alumina, diphosphorus pentoxide, calcium oxide, calcium chloride or a zeolite adsorbent may, for example, be employed. It is preferred to employ a zeolite adsorbent which is capable of adsorbing even a very small amount of moisture. It is more preferred to employ the same zeolite adsorbent as the zeolite adsorbent to be packaged as a product. If the same zeolite adsorbent as the product is employed as a dehydrating agent, it is possible to avoid contamination with a foreign matter even if a part of the dehydrating agent may fall into the product. The shape of the zeolite adsorbent to be used as a dehydrating agent, is not particularly limited. However, in a powder form, the pressure drop at the dehydrating agent portion tends to increase, whereby the gas desorbed from the zeolite adsorbent as the product tends to hardly escape to the exterior, and it may break the inner bag. Accordingly, it is preferred to employ agglomerates in the form of beads or pellets.

The amount of the dehydrating agent to be sealed in the sealing portion may suitably be determined depending upon the period for storage, the period required for transportation and the dehydrating ability of the dehydrating agent to be used. Further, the zeolite adsorbent has a nature to repeat adsorption and desorption due to a temperature difference or a pressure difference, and the amount of the dehydrating agent may also be determined taking into consideration the amount of air to be adsorbed or desorbed. Taking into consideration the above conditions or the form of the supersack, the amount of the dehydrating agent is usually preferably at a level of from 0.1 to 2 wt % of the zeolite adsorbent as the product.

By packaging the zeolite adsorbent by the above method, it is possible to prevent the zeolite adsorbent from being moistened by moisture permeating through the material or by moisture penetrating through a clearance at the sealing portion.

Further, in packaging the zeolite adsorbent, it is important not to let the zeolite adsorbent absorb moisture during the period from the step of dehydrating the zeolite adsorbent to the completion of packaging. For this purpose, the product transportation line in the production installation to be used for packaging the zeolite adsorbent and the interior of the packaging bag for packaging the product, preferably has a dew point which is as low as possible, and specifically, it may be in an atmosphere having a dew point of not higher than −30° C. Further, in order to prevent penetration of the open air, it is preferred to set the product transportation line and the interior of the packaging bag to be slightly higher than the atmospheric pressure.

The zeolite adsorbent to be packaged by the method of the present invention is not particularly limited. However, the method of the present invention is particularly effective for a zeolite adsorbent having a high affinity with moisture and having a relatively small $SiO_2/Al_2O_3$ molar ratio in the zeolite skeleton, such as a low silica X-type zeolite adsorbent, an X-type zeolite adsorbent, an A-type zeolite adsorbent, an A-type zeolite adsorbent or a Y-type zeolite adsorbent, which is useful for gas separation by e.g. a pressure swing adsorption method. It is particularly effective for the low silica X-type zeolite adsorbent.

The zeolite adsorbent packaged by the method of the present invention will scarcely loose its adsorption/separation performance, since permeation of moisture through the inner bag of a supersack is prevented or penetration of moisture from the sealing portion of the inner bag of a supersack can be prevented, during transportation or storage for a long period of time, or during filling an adsorption tower with it.

Now, the present invention will be described in further detail with reference to Examples. However, it should be understood that the present invention is by no means restricted to such specific Examples. The measurement of the moisture content of the zeolite adsorbent was carried out with reference to JIS K 0068 (that methods for water content of chemical products). Specifically, it was carried out by the following method.

A zeolite adsorbent was accurately weighed in an amount of from about 0.3 to 0.5 g, and the moisture was vaporized in an electric furnace set at 400° C. in a dry nitrogen stream (300 ml/min), and the vaporized moisture was collected in an electrolyte, followed by Karl Fisher titration (coulometric titration) to measure the moisture content. As the coulometric titration apparatus, CA-06 model, manufactured by Mitsubishi Chemical Corporation was employed, and as the electric furnace, VA-21 model, manufactured by Mitsubishi Chemical Corporation was employed. As the zeolite adsorbent, Li-ion exchanged faujasite type (LSX type) zeolite agglomerates (in the form of beads with a diameter of from 1.2 to 2.0 mm) having a $SiO_2/Al_2O_3$ molar ratio of 2.0, were employed. This adsorbent was prepared as follows.

Synthesis of the LSX zeolite was carried out by a conventional method. Into a stainless steel reactor having an internal capacity of 20 l, 3,888 g of an aqueous sodium aluminate solution ($Na_2O$=20.0 wt %, $Al_2O_3$=22.5 wt %), 7,923 g of water, sodium hydroxide (purity: 99%) and 1,845 g of potassium hydroxide of guaranteed grade (purity: 85%), were introduced and cooled with stirring at 60 rpm (solution a: about 5° C.). Into a polyethylene container having an internal capacity of 10 l, 7,150 g of an aqueous sodium silicate solution ($Na_2O$=3.8 wt %, $SiO_2$=12.6 wt %) and 1,176 g of water, were introduced and cooled (solution b: about 10° C.). While stirring solution a, solution b was introduced over a period of about 5 minutes. The solution after the introduction was transparent. After completion of the introduction, stirring was continued for about 20 minutes, and then the temperature of a water bath was raised to 36° C. When the solution turbidified, stirring was stopped, and the stirrer was taken out, whereupon aging was carried out at 36° C. for 48 hours.

Then, the temperature of the water bath was raised to 70° C., and crystallization was carried out for 20 hours. The obtained crystals were collected by filtration, thoroughly washed with pure water and then dried over night at 80° C. As a result of the X-ray diffraction, the structure of the crystal powder thereby obtained was found to be a single phase of faujasite, and from the result of the analysis of the composition by ICP-AES, it was confirmed to be LSX zeolite having a composition of $0.72Na_2O0.28K_2O.Al_2O_3.2.0SiO_2$.

To 100 parts by weight of this LSX zeolite powder, 20 parts by weight of attapulgite type clay was mixed and kneaded by a Mixmuller Mixing Machine (MSG-05S model, manufactured by Shintokogyo, Ltd.), and water was optionally added to finally adjust the amount of water added to be 65 parts by weight per 100 parts by weight of the LSX zeolite powder, whereupon the mixture was thoroughly kneaded.

This kneaded product was stirred and granulated into beads having diameters of from 1.2 to 2.0 mm by a stirring type granulator Henschel Mixer (FM/I-750 model, manufactured by Mitsui Mining Co., Ltd.), and the size of the agglomerates was adjusted for about 5 minutes by means of a marumerizer molding machine (Q-1000 model, manufactured by Fuji Paudal Co., Ltd.) followed by drying at 100° C. over night. Then, using a tube furnace (manufactured by Advantec), calcination was carried out at 650° C. for 2 hours in an air stream to sinter the attapulgite type clay, followed by cooling in the atmospheric air, and the resulting agglomerates were humidified so that the water content became about 25%.

The agglomerates thus obtained, were filled into a column of 70 mm in diameter×700 mm in length, and an aqueous solution prepared to bring the concentration of lithium chloride to 1 mol/l, was passed therethrough at 80° C. for lithium ion exchange. Then, the agglomerates filled in the column were thoroughly washed with pure water, then taken out from the column and dried at 40° C. for 16 hours.

Then, in a tube furnace (manufactured by Advantec), activation treatment was carried out at 60° C. for 1 hour in an air stream. Without cooling, the sample subjected to the activation treatment, was put into a can which can be air-tightly sealed, and then sealed and cooled. The samples used in Examples 1 to 3 and Comparative Example 1 and 2, were samples sealed and cooled in this manner.

EXAMPLE 1

Four types of packaging bags differing in the material or the thickness of the aluminum layer and having a size of 780 mm×480 mm, were used. In each packaging bag, 1 kg (about 1.5 l) of the zeolite adsorbent was packaged. Each packaging bag was sealed by heat sealing along the three sides of the rectangular shape. Then, the inlet for the zeolite adsorbent was sealed at a position A shown in FIG. 1 by means of a plastic binding band so as to avoid formation of a space in the interior as far as possible. Then, about 10 g of a dehydrating agent was introduced above the sealing portion, and the bag was sealed at a position B thereabove by a plastic binding band. Further, the inner bag was once folded back at a position thereabove and sealed at a position C by a plastic binding band. Each packaging bag having the zeolite adsorbent packaged therein and sealed, was stored for one month in a constant temperature and humidity drier (PL-2STH model, manufactured by Tabai Espec Corp.) having a relative humidity of 80%. The moisture content of the zeolite adsorbent was measured by the above described method, and the results are shown in Table 1.

TABLE 1

| | Packaging bag (1) | Packaging bag (2) | Packaging bag (3) | Packaging bag (4) |
|---|---|---|---|---|
| 0 day | 0.05 | 0.05 | 0.05 | 0.05 |
| 30 days | 0.10 | 0.12 | 0.11 | 0.13 |

The unit for the numerical values in the Table is wt %.

The materials of the packaging bags used were as shown in Table 2.

TABLE 2

| Materials | Packaging bag (1) | Packaging bag (2) | Packaging bag (3) | Packaging bag (4) |
|---|---|---|---|---|
| PET | 12 | 12 | 12 | 12 |
| PE | — | — | 15 | 15 |
| Al | 9 | 7 | 15 | 20 |
| ONY | 15 | 15 | 15 | 25 |
| PE | — | — | 15 | 15 |
| LLPE | 70 | 50 | 45 | 40 |

In Table 2, PET represents polyethylene terephthalate, Al aluminum, ONY o-nylon, PE polyethylene, and LLPE linear low density polyethylene. The numerical values in the materials represent the thicknesses of the respective materials (unit: $\mu$m). Further, packaging bags (1) and (2) were made by Ohishi Sangyo Co., Ltd., and packaging bags (3) and (4) were made by Nihon Matai Co., Ltd.

As is evident from the results of Table 1, there was no substantial increase in the moisture contents of the zeolite adsorbents by the storage for one month, and thus penetration of moisture from the sealed portions was prevented.

EXAMPLE 2

The size of the inner bag, the amount of the packaged zeolite adsorbent, the amount of the dehydrating agent and the sealing method were the same as in Example 1. The storage was done at a place where no air conditioning equipment was present, so that the zeolite adsorbent repeated adsorption and desorption depending upon the temperature difference between day time and night time. The storage period was one month, and the maximum room temperature was 34° C., and the minimum room temperature was 15° C. during the storage period. Further, the maximum relative humidity was 85%, and the minimum relative humidity was 32%. The moisture content of the zeolite adsorbent was measured by the above described method, and the results are shown in Table 3.

TABLE 3

| | Packaging bag (1) | Packaging bag (2) | Packaging bag (3) | Packaging bag (4) |
|---|---|---|---|---|
| 0 day | 0.05 | 0.05 | 0.05 | 0.05 |
| 30 days | 0.11 | 0.10 | 0.12 | 0.13 |

The unit for the numerical values in the Table is wt %.

As is evident from the results in Table 3, there was no substantial increase in the moisture contents of the zeolite adsorbents by the storage for one month, and even when the zeolite adsorbents repeated the adsorption and desorption phenomena due to the temperature difference, penetration of moisture from the sealed portions was prevented.

EXAMPLE 3

A storage test of a zeolite adsorbent was carried out by using a practical supersack. The employed zeolite adsorbent was prepared essentially in the same manner as in Example 1 except that the scale was enlarged. Packaging was carried out in an atmosphere having a dew point of −60° C. As the packaging inner bag, the packaging bag (1) was employed. The zeolite adsorbent packaged was about 500 kg, and the dehydrating agent was sealed in an amount of about 2 kg. The sealing method was the same as in Example 1. Namely, for sealing, a plastic binding band was used, and the sealing portions were between the zeolite adsorbent as the product and the dehydrating agent (position A in FIG. 1) and two positions above the dehydrating agent (positions B and C in FIG. 1, and at position C, the inner bag was folded bag and sealed), i.e. a total of three positions were sealed. The storage was done in a tent warehouse for about two months, and during the period, the maximum temperature was 16° C., and the minimum temperature was 4° C. Further, the maximum relative humidity was 80%, and the minimum relative humidity was 41%. Upon expiration of about two months, the zeolite adsorbent and the dehydrating agent were sampled, and their moisture contents were measured by the above described method, and the results are shown in Table 4.

TABLE 4

| | Zeolite adsorbent | Dehydrating agent |
|---|---|---|
| 0 day | 0.54 | 0.42 |
| 2 months | 0.56 | 2.09 |

The unit for the numerical values in the Table is wt %.

As is evident from the results in Table 4, the zeolite adsorbent did not absorb moisture even by the storage for about two months. Whereas, the dehydrating agent distinctly showed moisture absorption, and it is evident that the dehydrating agent absorbed moisture penetrating through a clearance at the sealing portion.

EXAMPLE 4

Packaging was carried out by the same packaging method as in Example 3, and the storage was done in a tent warehouse for 8 months. During the period, the maximum temperature was 36° C., and the minimum temperature was −3° C. Further, the maximum relative humidity was 85%, and the minimum relative humidity was 41%. Upon expiration of about 8 months, the zeolite adsorbent and the dehydrating agent were sampled, and their moisture contents were measured, and the results are shown in Table 5.

TABLE 5

| | Zeolite adsorbent | Dehydrating agent |
|---|---|---|
| 0 day | 0.07 | 0.07 |
| 8 months | 0.08 | 29 |

The unit for the numerical values in the Table is wt %.

As is evident from the results in Table 5, a study was carried out by using a zeolite adsorbent having a moisture content smaller than in Example 3, and even then, the zeolite adsorbent did not absorb moisture by the storage for about 8 months. Whereas, the dehydrating agent distinctly showed moisture absorption, and it is evident that the dehydrating agent absorbed moisture penetrating from a clearance at the sealed portion.

EXAMPLE 5

Packaging was carried out by the same packaging method as in Example 3, and the storage period was 13 months. The storage was done in a tent warehouse. During the period, the maximum temperature was 36° C., and the minimum temperature was −3° C. Further, the maximum relative humidity was 85%, and the minimum relative humidity was 41%. Upon expiration of about 13 months, the zeolite adsorbent and the dehydrating agent were sampled, and their moisture contents were measured. The results are shown in Table 6.

TABLE 6

| | Zeolite adsorbent | Dehydrating agent |
|---|---|---|
| 0 day | 0.41 | 0.42 |
| 13 months | 0.40 | 25 |

The unit for the numerical values in the Table is wt %.

As is evident from the results in Table 6, the zeolite adsorbent did not absorb moisture even by the storage for about 13 months. Whereas, the dehydrating agent distinctly showed moisture absorption, and it is evident that the dehydrating agent absorbed moisture penetrating from a clearance at the sealed portion.

Comparative Example 1

Figure 2:
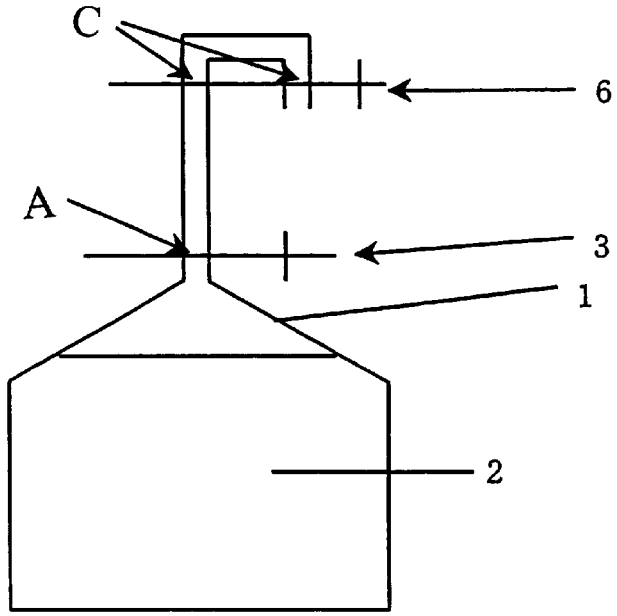
FIG. 2 is a schematic view illustrating the sealing method carried out in Comparative Example 1.

The test was carried out in the same manner as in Example 1 except that no dehydrating agent was employed, and sealing was carried out at two positions i.e. position A and C. A schematic view of this sealing method is given in FIG. 2. The moisture contents of the zeolite adsorbents were measured by the above described method, and the results are shown in Table 7.

TABLE 7

| | Packaging bag (1) | Packaging bag (2) | Packaging bag (3) | Packaging bag (4) |
|---|---|---|---|---|
| 0 day | 0.05 | 0.05 | 0.05 | 0.05 |
| 40 days | 0.27 | 0.30 | 0.48 | 0.42 |
| 80 days | 0.58 | 0.59 | 0.75 | 0.71 |

The unit for the numerical values in the Table is wt %.

As is evident from the results in Table 7, when no dehydrating agent was incorporated, the zeolite adsorbents distinctly showed moisture adsorption, and it is evident that moisture penetrated from the sealed portions.

Comparative Example 2

The test was carried out in the same manner as in Example 1 except that as the packaging bag, (5) LLPE 100 $\mu$m (manufactured by Ohishi Sangyo Co., Ltd.) was used. The moisture content of the zeolite adsorbent was measured by the above described method, and the results are shown in Table 8.

TABLE 8

| | Packaging bag (5) |
|---|---|
| 0 day | 0.05 |
| 30 days | 0.49 |

The unit for the numerical values in the Table is wt %.

As is evident from the results in Table 8, as compared with Examples 1 to 3, when a packaging bag made of polyethylene was used, even if a dehydrating agent was used, moisture permeated through the material of the inner bag, whereby the zeolite adsorbent absorbed moisture.

The present invention provides the following effects.

(1) Packaging a large amount of zeolite adsorbant using a supersack can be carried out by a simpler operation of sealing a packaging bag at two or more positions and at the time of packaging than the operation of packaging using a drum, and machine may be employed to facilitate the operation.

(2) Simply by disposing a dehydrating agent at the sealing portion, it is possible to prevent penetration of moisture in a gas through a clearance at the sealing portion, whereby it is possible to prevent deterioration of the zeolite adsorbent, during packaging, storage or transportation.

(3) The present invention is effective against adsorption and desorption of gas specific to the zeolite adsorbent, whereby the inner pressure of the packaging bag will not excessively increase, and breakage of the bag will not occur.

(4) Even with a packaged product of large amount like a packaged product in a supersack, an adsorption tower or the like can readily be filled with the zeolite adsorbent simply by opening a lower portion of the bag, whereby filling treatment can be completed simply or in a short period of time.

What is claimed is:

1. A method for filling an adsorption tower with a zeolite absorbent, comprising:

introducing the zeolite adsorbent into an opening of a packaging bag, said packaging bag having at least two layers including a metal layer;

sealing the bag above the introduced zeolite adsorbent;

then introducing a dehydrating agent through the opening;

sealing the bag above the introduced dehydrating agent;

moving the zeolite adsorbent packaged in the packaging bag to a position above the adsorption tower to be filled; and then opening a lower portion of the packaging bag to let the zeolite adsorbent drop in into the adsorption tower to be filled.

* * * * *